United States Patent [19]

Oberhardt et al.

[11] Patent Number: 5,029,369

[45] Date of Patent: Jul. 9, 1991

[54] LOCKING DEVICE FOR SAFETY BELTS IN MOTOR VEHICLES

[75] Inventors: Knut Oberhardt, Holzkirchen, Fed. Rep. of Germany; Walter Notar, Unterschleissheim, Austria

[73] Assignee: Autoliv-Kolb GmbH & Co., Dachau, Fed. Rep. of Germany

[21] Appl. No.: 423,114

[22] Filed: Oct. 19, 1989

[30] Foreign Application Priority Data

Oct. 19, 1988 [DE] Fed. Rep. of Germany ..... 3835508

[51] Int. Cl.[5] ..... A44B 11/26

[52] U.S. Cl. ..... 24/633

[58] Field of Search ..... 24/641, 642, 633, 636, 24/637, 638, 639, 640

[56] References Cited

U.S. PATENT DOCUMENTS

| | | | |
|---|---|---|---|
| 4,454,634 | 6/1984 | Haglund . | |
| 4,542,563 | 9/1985 | Befort | 24/641 |
| 4,575,908 | 3/1986 | Gloomis et al. | 24/637 X |
| 4,870,726 | 10/1989 | Eksell et al. | 24/636 |

FOREIGN PATENT DOCUMENTS

| | | | |
|---|---|---|---|
| 2043634 | 9/1970 | Fed. Rep. of Germany . | |
| 3533684 | 2/1987 | Fed. Rep. of Germany | 24/633 |
| 0212507 | 7/1986 | PCT Int'l Appl. . | |
| 88-06012 | 8/1988 | PCT Int'l Appl. | 24/633 |
| 2104141 | 3/1983 | United Kingdom . | |
| 1589059 | 5/1987 | United Kingdom | 24/642 |

*Primary Examiner*—James R. Brittain

*Attorney, Agent, or Firm*—Peter K. Kontler

[57] ABSTRACT

The tongue at the free end of a safety belt in a motor vehicle is releasably connected to the buckle by a coupling member which can be disengaged from the tongue by a reciprocable release member. The latter can be depressed by hand to thereby pivot (either entirely or in part) prior to completing a translatory movement which results in disengagement of the coupling member from the tongue. If the buckle is abruptly accelerated during an accident, the release member tends to carry out the translatory movement without a preceding pivotal movement whereby a stationary blocking element intercepts a blocking element on the release member and holds the latter against movement to a position in which the coupling member is caused or permitted to release the tongue. Alternatively, the release member is mounted for translatory movement to thereby disengage the coupling member from the tongue. Abrupt acceleration of the buckle results in pivoting of the release member prior to completion of translatory movement; this results in interception of the blocking element on the release member by the other blocking element to thus prevent unintentional disengagement of the coupling member from the tongue.

17 Claims, 2 Drawing Sheets

LOCKING DEVICE FOR SAFETY BELTS IN MOTOR VEHICLES

BACKGROUND OF THE INVENTION

The invention relates to safety locking devices in general, and more particularly to improvements in safety locking devices which can be used with advantage in motor vehicles to releasably secure belts or straps to buckles. Locking devices of the type to which the present invention pertains can be used in conjunction with front lap belts, shoulder belts or combinations of front lap and shoulder belts.

Haglund et al. U.S. Pat. No. 4,454,634 discloses a safety locking device wherein a buckle contains a pivotable coupling member which can releasably hold an inserted tongue. The buckle can be anchored in the seat or elsewhere in the motor vehicle, and the tongue is attached to one end of a belt. A release member is provided to disengage the coupling member so that the tongue is free to leave the buckle. The patented locking device is further equipped with an ejector which can automatically expel the tongue from the buckle when the release member has caused the coupling member to free the tongue for movement relative to the buckle. The release member is a depressible part which is movable in parallelism with the plane of the inserted tongue and is biased to a starting or inoperative position by a coil spring or the like.

Locking devices of the above outlined characters are normally used with so-called lock tighteners. If the tightener is deactivated in the event of an accident, the thus released energy causes acceleration of the entire locking device in a direction toward the floor of the motor vehicle, and the locking device is thereupon abruptly decelerated when it reaches an obstruction while assuming a lower end position. Depending on the design of the locking device, its parts can be subjected to acceleration in the range of 500 to 1000 g. The inertia of the release element is sufficiently pronounced to cause automatic movement of the release member to its operative position and to thus cause the coupling member to free the tongue, i.e., to disengage the free end of the belt from the buckle. This can result in injury to, or in death of, the user of the belt.

In accordance with a proposal which is discussed in published European patent application No. 0 212 507, activation of the aforementioned tightener automatically entails blocking of the release member in its inoperative position. The published application proposes to provide a mass or weight which compensates for the mass of the release member and is connected with the latter by means of a lever. This published application further proposes to modify the just described structure by employing a lever the inertia of which is high and which enters the space between its bearing means and the release member in the event of abrupt acceleration of the locking device. Still further, the published application proposes to combine, or to provide the release member, with a shock absorber which is to prevent abrupt changes of position of the release member in the event of undue acceleration of the locking device.

OBJECTS OF THE INVENTION

An object of the invention is to provide a locking device which is simpler and more reliable than heretofore known locking devices.

Another object of the invention is to provide a novel and improved release member for use in the above outlined locking device.

A further object of the invention is to provide a novel and improved combination of buckle and release member for use in the above outlined locking device.

An additional object of the invention is to provide a locking device wherein accidental movement of the release member to operative position is highly unlikely or plain impossible.

Still another object of the invention is to provide a locking device wherein only intentional displacement of the release member can result in disengagement of the tongue from the buckle.

A further object of the invention is to provide a compact and inexpensive locking device which can be used as a superior substitute for conventional locking devices.

Another object of the invention is to provide a crash-proof locking device for use on or with safety belts in motor vehicles or for analogous purposes.

An additional object of the invention is to provide a novel and improved method of preventing accidental opening of locking devices for the safety belts of motor vehicles.

SUMMARY OF THE INVENTION

One feature of the present invention resides in the provision of a locking device for safety belts in motor vehicles. The improved locking device comprises a buckle, a tongue which is insertable into the buckle, coupling means provided in or on the buckle and movable between a first position in which the inserted tongue is connected to the buckle and a second position in which the tongue is free to leave the buckle (e.g., in response to extraction and/or in response to expulsion by a spring or the like), and means for moving the coupling means to the second position. The moving means includes a manually operable (movable) release member which is or can be mounted in or on the buckle for movement in a first direction to thereby move the coupling means to the second position, and at least a predetermined portion of the release member is further movable in a second direction. The locking device further comprises means for blocking the movement of the release member in the first direction (either entirely or at least to the extent which is necessary to move the coupling means to the second position) prior to completion of movement of the predetermined portion of the release member in the second direction. The arrangement is or can be such that the movement of the release member in the first direction is a substantially translatory movement and that the movement of the predetermined portion of the release member in the second direction is a substantially angular movement.

In accordance with one presently preferred embodiment of the improved locking device, the release member further comprises a second portion and a hinge between the predetermined portion and the second portion. The predetermined portion is then pivotable with reference to the second portion in and counter to the second direction, i.e., the hinge defines a pivot axis (such pivot axis is or can be at least substantially normal to the first direction) and the movement of the predetermined portion in the second direction involves an angular movement of the predetermined portion about the pivot axis.

The blocking means can include a first blocking element which is provided on the predetermined portion of the release member and a fixed second blocking element which is located in the path of movement of and can arrest the first blocking element if the movement of the release member in the first direction precedes the movement of the predetermined portion of the release member in the second direction. However, the second blocking element is bypassed by the first blocking element if the movement of the predetermined portion of the release member in the second direction precedes the movement of the release member in the first direction.

The aforementioned hinge can be integral with the predetermined and second portions of the release member. One of the two integrally connected portions of the release member can be provided with means for yieldably biasing the predetermined portion of the release member counter to the second direction. Such biasing means can include a spring which is integral with the one portion and bears against the other portion of the release member.

The apparatus further comprises one or more coil springs or other suitable means for biasing the release member counter to the first direction to a predetermined starting position. The biasing means can define for the release member a pivot axis which extends substantially transversely of the first direction. If the predetermined portion of the release member is rigid or integral with the second portion, the movement in the second direction can involve a pivotal movement of the predetermined portion (and hence also of the second portion) of the release member about such pivot axis. The second portion of the release member is or can be directly or indirectly engaged by the biasing means. The blocking means of such locking device preferably comprises a first blocking element on one portion of the release member and a fixed second blocking element which is located in the path of movement of the first blocking element if the movement of the release member in the first direction precedes the movement of the predetermined portion of the release member in the second direction but which is bypassed by the first blocking element if the movement of predetermined portion in the second direction precedes the movement of the release member in the first direction.

The arrangement may be such that the center of gravity of the release member (particularly a onepiece release member) is remote from the pivot axis which is defined by the means for biasing the release member counter to the first direction. The release member has a side which confronts the inserted tongue of the locking device and the pivot axis for the release member can be adjacent such side of the release member. Alternatively, the pivot axis can be adjacent that side of the release member which is remote from the tongue. The biasing means of such locking device can include at least one resilient element acting upon the release member in a third direction substantially counter to the first direction, and the center of gravity of the release member is preferably located in line with the direction of action of the at least one resilient element upon the release member.

Another feature of the invention resides in the provision of a locking device for safety belts in motor vehicles which comprises a buckle that is accelerated in a first direction in the event of an accident or in other emergency situation, a tongue which is insertable into the buckle, coupling means provided in or on the buckle and movable between a first position in which the inserted tongue is connected to the buckle and a second position in which the tongue is free to leave the buckle, and means for moving the coupling means from the first to the second position. The moving means includes a manually operable (movable) release member which is or can be mounted in or on the buckle for movement in a given direction to thereby move the coupling means to the second position. The release member is confined to movement in a third direction in response to acceleration of the buckle, and the locking device further comprises means for blocking the movement of the release member in the second direction when the movement of the release member in the third direction precedes the movement in the given direction. The movement of the release member in the first direction is or can be substantially the same as in the given direction, and the movement of the release member in the third direction can be an angular movement.

Means can be provided to permanently bias the release member counter to the third direction. The blocking means of the modified locking device can again comprise a fixed first blocking element and a second blocking element which is provided on the release member and can bypass the first blocking element (to enable the release member to move the coupling means to the second position) only when the movement of the release member in the given direction precedes the movement of the release member in the third direction, i.e., the tongue cannot be freed in the event of an accident or in a situation which entails acceleration of the buckle in the first direction.

The novel features which are considered as characteristic of the invention are set forth in particular in the appended claims. The improved locking device itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
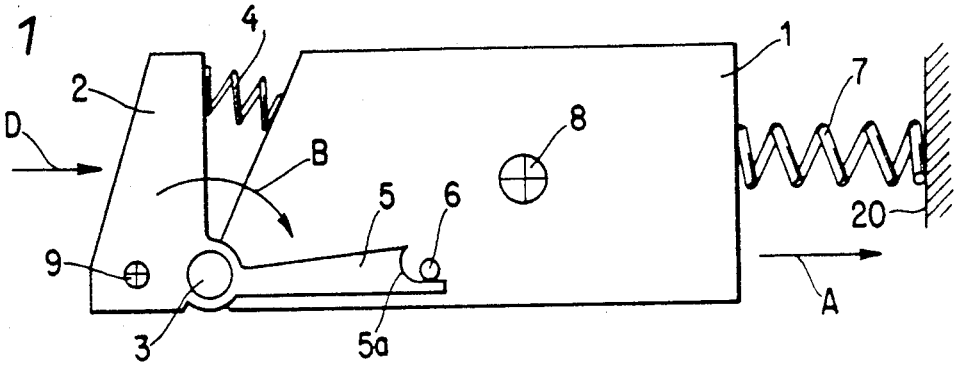
FIG. 1 is a schematic elevational view of a release member and of blocking means which can be utilized in a locking device embodying our invention.
Figure 6:
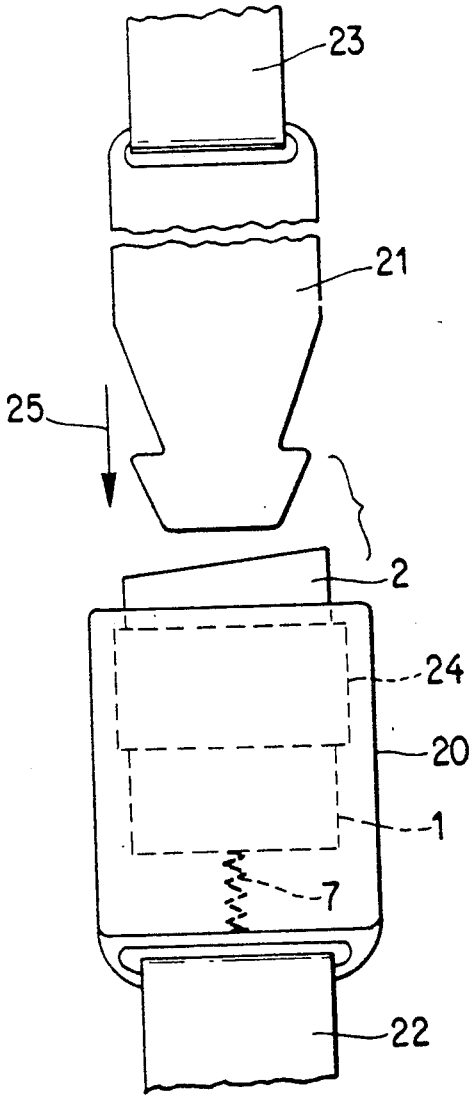
FIG. 6 is a schematic plan view of a locking device which employs the release member of FIG. 1, 2, 3, 4 or 5.

Referring first to FIG. 6, there is shown a locking device which includes a buckle 20 fixed to the seat or to the floor of a motor vehicle by a strap 22 or in any other suitable way, and a tongue 21 which is secured to one end portion of a safety belt or strap 23 and is insertable into the buckle 20 in the direction of arrow 25. Insertion of the tongue 21 into the buckle 20 entails the movement of a coupling member 24 in the buckle 20 from a second to a first position to thereby reliably but still separably connect the tongue to the buckle, and the locking device further comprises a novel and improved release member including a first (predetermined) portion 2 which can be operated by hand (by being moved in the direction of arrow D shown in FIG. 1) to thereby move the coupling member 24 from the first to the second position, i.e., the tongue 21 is then free to leave the buckle 20, either in response to a pull counter to the direction which is indicated by the arrow 25 or in response to expulsion from the buckle by a spring, not shown in FIGS. 1 and 6 (or by a coil spring 7 which is shown in FIGS. 1 and 6 and serves to oppose the movement of the release member including the portion 2 in the direction of arrow A.

The heretofore described parts of the locking device (with the exception of the release member including the predetermined portion 2) are or can be similar to the corresponding parts of the locking device (called safety belt buckle) which is disclosed in the aforementioned U.S. Pat. No. 4,454,634 granted June 19, 1984 to Haglund et al. The disclosure of the patent to Haglund et al. is incorporated herein by reference. In the patent to Haglund et al., the buckle (2) is called a locking device, the tongue (1) is called a locking tongue, and the coupling member (9) is called a locking member. Haglund et al. employ a different release member (16) which is called a buckle trigger.

Referring again to FIGS. 1 and 6, the buckle 20 can be located at a level beneath the exposed portion of the tongue 21 when the latter is properly inserted into and is connected to the buckle by the coupling member 24. The coil spring 7 serves as a means for biasing the release member including the predetermined portion 2 counter to the (first) direction which is indicated by arrow A. The predetermined portion 2 is articulately connected to a second or main portion 1 of the release member by a hinge including a pintle 3. A second coil spring 4 is provided to bias the portion 2 in a counterclockwise direction (as seen in FIG. 1), namely in a direction counter to that (called second direction) which is indicated by arrow B and in which the portion 2 is pivoted about the axis of the pintle 3 when the operator of the improved locking device applies a pressure in the direction of arrow D. Thus the application of manual pressure in the direction of arrow D results in angular movement of the portion 2 in the direction of arrow B before the portions 2 and 1 begin to move as a unit in the direction of arrow A, namely substantially at right angles to the axis of the pintle 3. Translatory movement of the entire release member (including the portions 1 and 2) in the direction of arrow A results in or entails a movement of the coupling member 24 to its second position in which the inserted tongue 21 is free to leave the buckle 20.

The coil spring 7 reacts against the buckle 20 or against any other stationary part in the motor vehicle. The end portions of the coil spring 4 can be recessed into the adjacent surfaces of the portions 1 and 2. Alternatively, one end convolution of the coil spring 4 can be rigidly or otherwise connected to and reacts against one of the portions 1, and the other end portion or convolution of such spring then bears against the other portion of the release member. The center of gravity of the portion is shown at 9 (it is rather close to and is located above the pintle 3), and the center of gravity of the portion 1 is shown at 8. This center of gravity is remote from the locus of engagement of the portion 1 with the coil spring 7. The mass of the portion 2 is or can be a minute fraction of the mass of the portion 1.

The locking device which includes the structure of FIGS. 1 and 6 further comprises means for blocking the movement of portions 1, 2 in the direction of arrow A if such movement precedes the movement of the portion 2 in the direction of arrow B. This is desirable and advantageous in the event of an accident when the entire release member tends to move in the direction of arrow A and such movement is not initiated by or attributable to the application of manually induced force to the portion 2 (in the direction of arrow D). The blocking means comprises a first blocking element 5 in the form of an elongated arm which is rigid or integral with the portion 2 and extends substantially radially of the pintle 3 toward the coil spring 7, and a second blocking element 6 which is fixed to the buckle 20 or is secured directly to the frame or body of the motor vehicle and is located in the path of movement of the free end portion of the arm 5 when the movement of the portions 1, 2 in the direction of arrow A is not preceded by a movement of the portion 2 in the direction of arrow B. However, if the portion 2 is caused to pivot about the axis of the pintle 3 (arrow B) in response to the application of finger pressure in the direction of arrow D, the concave surface **5*a* bounding the seat at the free end of the arm 5 is moved downwardly (as seen in FIG. 1) to a level beneath the fixedly mounted blocking element 6 so that the portions 1, 2 of the release member are free to move in the direction of arrow A whereby the release member moves the coupling member 24 to that (second) position in which the tongue 21 is free to leave the buckle 20. Movement of the portion 1 in the direction of arrow A causes the spring 7 to store energy; this enables the spring 7 to return the release member to its starting position as soon as the application of pressure upon the portion 2** (in the direction of arrow D) is terminated.

It goes without saying that the buckle 20 is provided with suitable guide means serving to ensure that depression of the portion 2 in the direction of arrow D results in a movement of the portion 1 in the direction of arrow A, i.e., the portion 1 is confined to movement along a path wherein it must advance in order to move the coupling member 24 from the first to the second position.

As can be seen in FIG. 1, the arm 5 of the blocking means actually abuts the blocking element 6 in the starting position of the release member. However, the concave surface **5*a* in the socket of this arm is sufficiently remote from the blocking element 6 to ensure that the arm can be pivoted in a clockwise direction and its surface 5*a* bypasses the blocking element 6 if the portion 2 of the release member is pivoted in the direction of arrow B before the portion 1** of the release member begins to move in the direction of arrow A.

The spring 4 is weaker than the spring 7, i.e., the application of pressure in the direction of arrow D invariably results in clockwise pivoting of the portion 2 about the axis of the pintle 3 before the portions 1 and 2 start to move in the direction of arrow A to bring about compression of the spring 7.

The arrangement may be such that the portions 1, 2 begin to move in the direction of arrow A while the portion 2 pivots about the axis of the pintle 3, as long as the extent of movement of the portions 1, 2 in the direction of arrow A is less than necessary to prevent the portion 2 from moving the arm 5 of the blocking means 5, 6 to a position in which the concave surface **5*a* can bypass the fixed blocking element 6. In other words, the movement of portion 2 in the direction of arrow B can be superimposed upon the initial stage of movement of the portions 1, 2 in the direction of arrow A, as long as the arm 5 is free to bypass the fixed blocking element 6. Otherwise, the blocking element 6 intercepts the surface 5***a* and prevents any further movement of the release member in the direction of arrow A, i.e., the tongue 21 remains connected to the buckle 20 because the portion 1 of the release member is incapable of assuming that position in which the movement of the coupling member 24 to its second position is completed.

Figure 5:
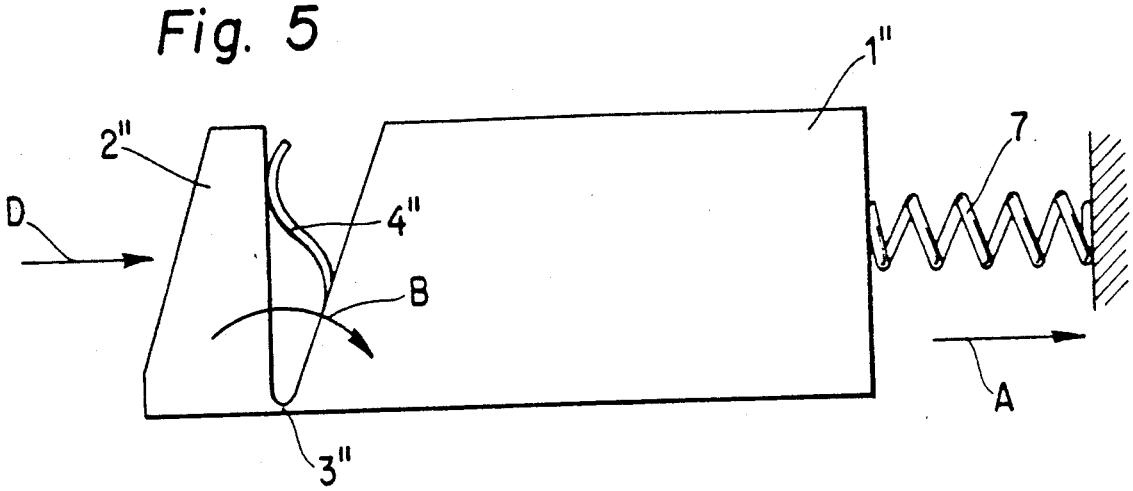
FIG. 5 is a schematic elevational view of a release member constituting a modification of the release member of FIG. 1.

FIG. 5 shows that the portion 2″ of the release member can be integrally connected to the second portion 1″ by a modified hinge 3″ consisting of a flexible web. The portion 1″ is provided with a spring 4″ (e.g., a leaf spring) which biases the portion 2″ to a starting position in which the portion 2″ can be pivoted by hand about the axis of the pintle 3″ (arrow B) before the portions 1″ and 2″ begin to move as a unit in the direction of arrow A. The portions 1″, 2″ can be made of a suitable plastic material, and the spring 4″ can be integral with the portion 1″. It is clear that the spring 4″ can be integral with the portion 2″ and then bears against the portion 1″. The release member including the structure of FIG. 5 can be mass-produced in an injection molding or other suitable machine. The blocking means which cooperates with the release member of FIG. 5 can be similar to or practically identical with the blocking means 5, 6 of FIG. 1, i.e., a first blocking element can be provided on and is pivotable with the portion 2″ in the direction of arrow B to thereby bypass the fixed blocking element on the buckle or on another fixed part of the motor vehicle.

The bias of the spring 4 or 4″ should suffice to ensure that an acceleration of the buckle 20 in the direction of arrow A does not result in pivoting of the portion 2 or 2″ in the direction of arrow B but that such acceleration merely entails an attempt of both portions (1, 2 or 1″, 2″) of the release member to move in the direction of arrow A, i.e., the portion 2 or 2″ is not pivoted in the direction of arrow B and, therefore, the arm 5 of the blocking means cannot bypass the fixed blocking element 6. Such bypassing of the blocking element 6 is possible only if the portion 2 or 2″ of the release member is pivoted by hand to move in the direction of arrow B before the concave surface 5*a* bounding the socket of the arm 5 reaches and is intercepted by the fixed blocking element 6.

Figure 2:
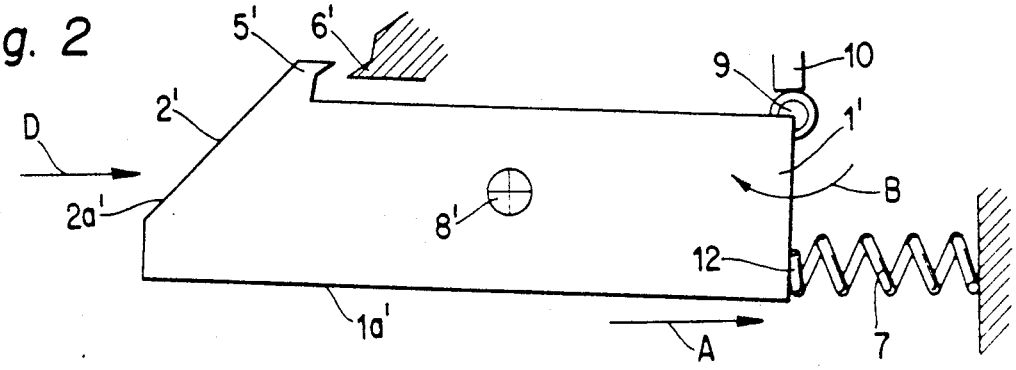
FIG. 2 is a similar view of a modified release member and of modified blocking means.

FIG. 2 shows a modified release member wherein the portion 2′ is integral with the portion 1′. This one-piece release member carries a hook-shaped first blocking element 5′ which can bypass a fixed blocking element 6′ of the buckle 20 only if the movement of the release member in the direction of arrow A is preceded by a pivotal movement of the entire release member about the axis of a pivot member 9 which abuts a stop 10 of the buckle 20. The coil spring 7 (which yieldably opposes the movement of the release member in the direction of arrow A) engages (at 12) the release member adjacent that side 1*a*′) which is nearest to the properly inserted tongue 21 (not shown) of the locking device employing the release member of FIG. 2. The center of gravity 8′ of the release member of FIG. 2 is remote from the point 12 as well as from the side 5*a*′ of the release member.

The buckle 20 is designed to guide the onepiece release member of FIG. 2 in such a way that the entire release member has freedom of pivotal movement in the direction of arrow B (in response to the application of finger pressure in the direction of arrow D) in order to enable the blocking element 5′ to bypass the fixed blocking element 6′. The inclination of the exposed side 2*a*′ of the depressible portion 2′ of the release member of FIG. 2 is sufficiently pronounced to ensure that the initial stage of movement of the one-piece release member in response to the application of finger pressure in the direction of arrow D involves a pivoting of the entire release member in the direction of arrow B, such initial stage being followed by movement in the direction of arrow A until the coupling device 24 assumes its second position and frees the tongue for movement away from the buckle 20. The surface 2*a*′ can be roughened to facilitate depression of the portion 2′ in the direction of arrow D.

If the one-piece release member of FIG. 2 is accelerated in the direction of arrow A, the fixed blocking element 6′ intercepts the mobile blocking element 5′ and the release member is arrested before it completes or initiates the movement of the coupling member to the second position. The position of the center of gravity 8′ of the one-piece release member of FIG. 2 is such that acceleration of the release member with the buckle 20 does not result in pivoting of the release member in the direction of arrow B, i.e., the blocking means 5′, 6′ is effective to prevent the coupling member 24 from becoming disengaged from the tongue when such disengagement could result in injury to the user of the safety belt and of the improved locking device. Acceleration of the one-piece release member of FIG. 2 in the direction of arrow A can result in tilting or pivoting of the release member at 12; however, such tilting takes place following a certain deformation of the spring 7 so that the blocking element 5′ already overlies the blocking element 6′ and the latter prevents further translatory movement of the release member in the direction of arrow A.

Figure 3:
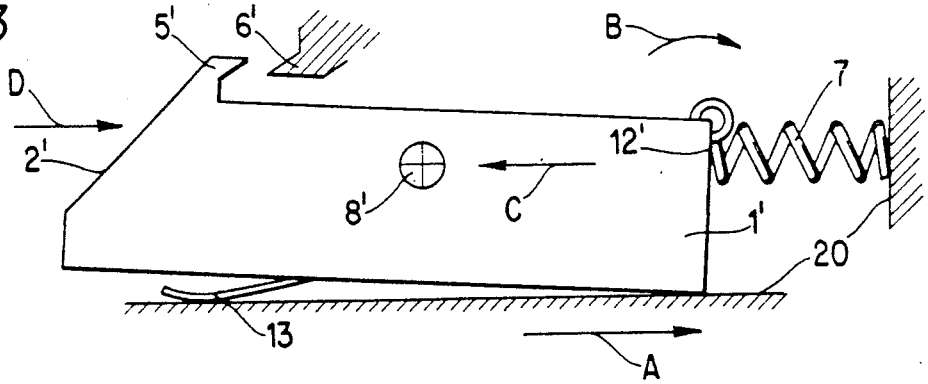
FIG. 3 is a similar view of a release member constituting a modification of the release member of FIG. 2.

FIG. 3 shows a one-piece release member which constitutes a modification of the release member of FIG. 2. The difference is that the pivot point 12′ of engagement of the coil spring 7 with the portion 1′ of the one-piece release member is remote from that side (1*a*′) of the release member which confronts the inserted tongue (not shown). Moreover, the center of gravity 8′ of the release member of FIG. 3 is selected in such a way that it is in line with the direction of action of the spring 7 upon the release member (note the arrow C in FIG. 3).

The release member of FIG. 3 is integral with or is connected with one end portion of a leaf spring 13 which bears against the adjacent portion of the buckle 20 and tends to maintain the release member in an angular position (with reference to the pivot axis at the point 12′) in which a translatory movement of the entire release member in the direction of arrow A (e.g., in response to abrupt acceleration of the buckle 20 in the direction of arrow A) would result in engagement (i.e., interception) of the movable blocking element 5′ by the fixed blocking element 6′. However, if a person applies finger pressure in the direction of arrow D, the release member is caused to pivot (at 12′) in the direction of arrow B and causes the spring 13 to store energy before the release member begins to move in the direction of arrow A. This enables the blocking element 5′ to bypass the fixed blocking element 6 and the release member can move the coupling member 24 (not shown in FIG.

3) to its second position to thus free the tongue for movement out of the buckle 20.

Figure 4:
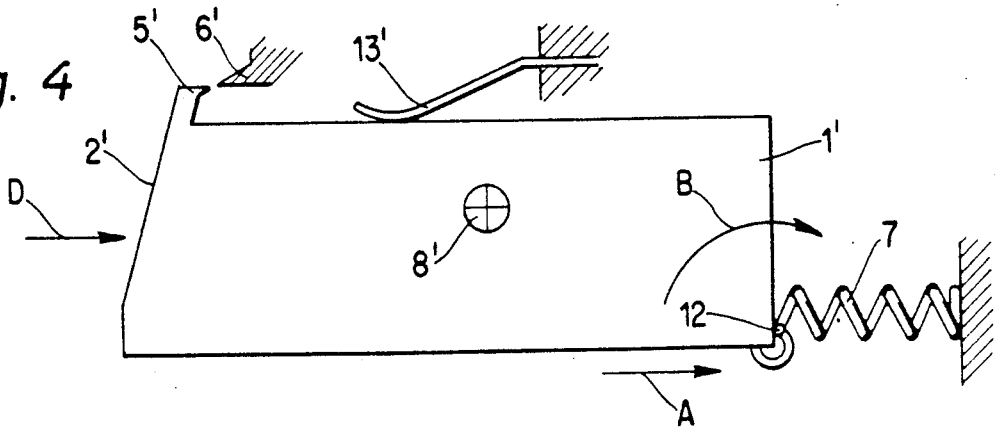
FIG. 4 is a similar view of a third release member.

FIG. 4 shows a third one-piece release member which is mounted in such a way that a translatory movement in the direction of arrow A (without prior pivoting of the portion 2' of or of the entire release member) enables the release member to move the coupling member (not shown in FIG. 4) to its second position. A leaf spring 13' which is anchored in the buckle 20 or in another part bears upon the adjacent side of the one-piece release member to ensure that the blocking element 5' can bypass the fixed blocking element 6' in immediate response to translatory movement of the release member in the direction of arrow A. The point 12 of engagement between the spring 7 and the release member, and the position of the center of gravity 8' of this release member, are selected in such a way that, when the buckle 20 and the release member are abruptly accelerated in the direction of arrow A, the center of gravity 8' causes the release member to turn clockwise (arrow B) about the pivot axis which is defined by the spring 7 so that the spring 13' is caused to store energy and the blocking element 5' moves upwardly (as seen in FIG. 4) in order to be intercepted by the fixed blocking element 6' before the release member can complete or initiate the movement of the coupling member (not shown in FIG. 4) to its second position. Thus, in this embodiment of the improved locking device, pivoting of the release member takes place in the event of acceleration of the buckle 20 and does not precede the translatory movement of the release member in the direction of arrow A when the portion 2' is intentionally depressed in the direction of arrow D.

The center of gravity 8' of the release member of FIG. 4 is not in line with the direction of action of the spring 7 upon the portion 1' of the release member. This ensures that the center of gravity 8' can cause the release member to move in the (third) direction of arrow B and to thus ensure that the blocking element 6' can intercept the blocking element 5' when the buckle 20 is abruptly accelerated in a first direction (which coincides with the (given) direction of arrow A). On the other hand, mere depression of the portion 2' in the direction arrow D results in a movement of the entire release member in the (second) direction of arrow A to thus ensure that the blocking element 5' bypasses the blocking element 6'.

The springs 13 and 13' can be said to form part of guide means for the respective one-piece release members.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A locking device for safety belts in motor vehicles comprising a buckle; a tongue insertable into said buckle; coupling means movable relative to said buckle between a first position in which the inserted tongue is connected to said buckle and a second position in which the tongue is free to leave the buckle; means for moving said coupling means to said second position, including a manually operable release member mounted in said buckle for movement in a first direction to thereby move the coupling means to said second position, at least a predetermined portion of said release member being further movable in a second direction, the movement of said release member in said first direction being a substantially translatory movement and the movement of said predetermined portion in said second direction being a substantially angular movement; and means for blocking the movement of said release member in said first direction prior to completion of movement of said predetermined portion of said release member in said second direction.

2. The locking device of claim 1, wherein said release member further comprises a second portion and a hinge between said predetermined portion and said second portion, said predetermined portion being pivotable with reference to said second portion in and counter to said second direction.

3. The locking device of claim 2, wherein said blocking means includes an element on said predetermined portion of said release member.

4. The locking device of claim 1, wherein said blocking means comprises a fixed first blocking element and a second blocking element provided on said predetermined portion and arranged to bypass said first blocking element when the movement of said predetermined portion in said second direction precedes the movement of said release member in said first direction.

5. A locking device for safety belts in motor vehicles, comprising a buckle which is accelerated in a first direction in the event of an accident; a tongue insertable into said buckle; coupling means movable with reference to said buckle between a first position in which the inserted tongue is connected to said buckle and a second position in which the tongue is free to leave said buckle; means for moving said coupling means to said second position, including a manually operable release member mounted in said buckle for movement in a given direction to thereby move the coupling means to said second position, said release member being confined to movement in a third direction different from said given direction in response to acceleration of said buckle; and means for blocking the movement of said release member in said given direction when the movement of said release member in said third direction takes place prior to movement in said given direction.

6. A locking device for safety belts in motor vehicles, comprising a buckle which is accelerated in a first direction in the event of an accident; a tongue insertable into the buckle; coupling means movable with reference to said buckle between a first position in which the inserted tongue is connected to said buckle and a second position in which the tongue is free to leave said buckle; means for moving said coupling means to said second position, including a manually operable release member mounted in said buckle for movement in a given direction to thereby move the coupling means to said second position, the movement of the buckle in said first direction being substantially the same as the movement of said release member in said given direction and said release member being confined to movement in a third direction in response to acceleration of said buckle, the movement of said release member in said third direction being an angular movement; and means for blocking the movement of said release member in said given direction when the movement of said release member in said third direction takes place prior to movement in said given direction.

7. The locking device of claim 6, further comprising means for biasing said release member counter to said third direction.

8. The locking device of claim 6, wherein said blocking means comprises a fixed first blocking element and a second blocking element provided on said release member and arranged to bypass said first blocking element only when the movement of the release member in said given direction precedes the movement in said third direction.

9. A locking device for safety belts in motor vehicles, comprising a buckle; a tongue insertable into said buckle; coupling means movable relative to said buckle between a first position in which the inserted tongue is connected to said buckle and a second position in which the tongue is free to leave the buckle; means for moving said coupling means to said second position, including a manually operable release member mounted in said buckle for movement in a first direction to thereby move the coupling means to said second position, at least a predetermined portion of said release member being further movable in a second direction and said release member further comprising a second portion and a hinge integral with said portions and defining for said predetermined portion a pivot axis extending substantially transversely of said first direction; and means for blocking the movement of said release member in said first direction prior to completion of movement of said predetermined portion of said release member in said second direction.

10. The locking device of claim 9, wherein said release member includes means for yieldably biasing said predetermined portion counter to said second direction.

11. The locking device of claim 10, wherein said biasing means includes a spring which is integral with one of said portions and bears against the other portion of said release member.

12. A locking device for safety belts in motor vehicles, comprising a buckle; a tongue insertable into said buckle; coupling means movable relative to said buckle between a first position in which the inserted tongue is connected to said buckle and a second position in which the tongue is free to leave the buckle; means for moving said coupling means to said second position, including a manually operable release member mounted in said buckle for movement in a first direction to thereby move the coupling means to said second position, at least a predetermined portion of said release member being further movable in a second direction; means for blocking the movement of said release member in said first direction prior to completion of movement of said predetermined portion of said release member in said second direction; and means for biasing said release member substantially counter to said first direction to a predetermined starting position, said biasing means defining for said release member a pivot axis extending substantially transversely of said first direction and said predetermined portion being arranged to pivot about said axis during movement in said second direction.

13. The locking device of claim 12, wherein said release member further comprises a second portion which is rigid with said predetermined portion and is engaged by said biasing means.

14. The locking device of claim 13, wherein said blocking means comprises a fixed first blocking element and a second blocking element provided on one of said portions and arranged to bypass said first blocking element when the movement of said portions in said second direction precedes the movement of said portions in said first direction.

15. The locking device of claim 14, wherein said release member has a center of gravity which is remote from said pivot axis, said release member having a side confronting the inserted tongue and said pivot axis being adjacent said side.

16. The locking device of claim 14, wherein said release member has a center of gravity which is remote from said pivot axis, said release member having a side facing said tongue and said pivot axis being remote from said side.

17. The locking device of claim 16, wherein said biasing means includes at least one resilient element acting upon said release member in a third direction substantially counter to said first direction, said center of gravity being located in line with the direction of action of said at least resilient element upon said release member.

* * * * *